US007331206B2

(12) United States Patent
Aoyama

(10) Patent No.: US 7,331,206 B2
(45) Date of Patent: Feb. 19, 2008

(54) METHOD OF FABRICATING COMPONENT HAVING INTERNAL TEETH AND ROLLING MACHINE THEREOF

(75) Inventor: Tsuyoshi Aoyama, Misato (JP)

(73) Assignee: M.H. Center Limited (JP)

( * ) Notice: Subject to any disclaimer, the term of this patent is extended or adjusted under 35 U.S.C. 154(b) by 0 days.

(21) Appl. No.: 10/560,535

(22) PCT Filed: Jul. 21, 2004

(86) PCT No.: PCT/JP2004/010329

§ 371 (c)(1),
(2), (4) Date: Dec. 13, 2005

(87) PCT Pub. No.: WO2005/009646

PCT Pub. Date: Feb. 3, 2005

(65) Prior Publication Data

US 2006/0144111 A1 Jul. 6, 2006

(30) Foreign Application Priority Data

Jul. 25, 2003 (JP) ..... 2003-280501
Dec. 22, 2003 (JP) ..... 2003-425952
Dec. 22, 2003 (JP) ..... 2003-425955

(51) Int. Cl.
*B21H 1/12* (2006.01)

(52) U.S. Cl. ..... 72/91; 72/102; 72/85; 72/125

(58) Field of Classification Search ..... 72/67, 72/85, 91, 102, 120, 121, 447, 449, 83, 84, 72/105, 111, 125; 29/893.32

See application file for complete search history.

(56) References Cited

U.S. PATENT DOCUMENTS 3,636,744 A * 1/1972 Motz et al. ..... 72/91

(Continued)

FOREIGN PATENT DOCUMENTS

DE 10144055 9/2000

(Continued)

OTHER PUBLICATIONS

Catalogue of a Finishing Gear Rolling Machine for Taper Flank of Internal Involute Spline "GR-151N" fabricated by Yutaka Seimitsu Kogyu Ltd.

(Continued)

*Primary Examiner*—Ed Tolan
(74) *Attorney, Agent, or Firm*—Blackwell Sanders LLP

(57) ABSTRACT

The present invention provides method of fabricating components having internal teeth and rolling machine thereof, enabling large deformation at main rolling step omitting broaching step and step using gear shaper. A container having toughness against internal pressure as high as that of cold forging is provided instead of gripping mechanism of a cylindrical material. A cylindrical material is inserted into the rotatably driven container in aligned manner. A rotatably driving rolling tool is acted on the inner side to press the cylindrical material and distance between tool rotational shaft and container rotational axis is sequentially changed to successively grow tooth profile. A component having internal teeth filling the container is obtained by enlarging outer diameter by spreading. It is desirable to provide in advance the same number of concave grooves as that of internal teeth to be formed, at equal intervals on an inner circumferential face of the cylindrical material.

11 Claims, 8 Drawing Sheets

U.S. PATENT DOCUMENTS

| | | | | |
|---|---|---|---|---|
| 4,909,056 | A * | 3/1990 | Ragettli | 72/91 |
| 5,307,662 | A * | 5/1994 | Tsuzuki | 72/91 |
| 6,959,576 | B2 * | 11/2005 | Hastings et al. | 72/91 |

FOREIGN PATENT DOCUMENTS

| | | | |
|---|---|---|---|
| DE | 19910474 | | 3/2003 |
| EP | 0259508 | | 3/1988 |
| JP | 57-32842 | | 2/1982 |
| JP | 19825732842 | | 2/1982 |
| JP | 157058/1987 | | 4/1989 |
| JP | 19871570581987 | | 4/1989 |
| JP | 2861424 | B2 | 12/1998 |
| JP | 19982861424 | | 12/1998 |

OTHER PUBLICATIONS

Yutaka Seimitsu Kogo Ltd.; "[GR-151N] Finishing Gear Rolling machine for Taper Flank of Internal Involute Spline;" website: http://www.yutaka.co.jp/Y_hp6/gr-151.htm.; pp. 1 and 2; Aug. 31, 2005.

* cited by examiner

METHOD OF FABRICATING COMPONENT HAVING INTERNAL TEETH AND ROLLING MACHINE THEREOF

CROSS-REFERENCE TO RELATED APPLICATION

This application is a U.S. National Stage application claiming the benefit of prior filed International Application Number PCT/JP2004/010329, filed Jul. 21, 2004, in which the International Application claims the priority from Japanese Patent Application Nos. 2003-280501, 2003-425952, 2003-425955, each filed on Jul. 25, 2003, Dec. 22, 2003 and Dec. 22, 2003, the entire contents of which are incorporated herein by reference.

BACKGROUND OF THE INVENTION

1. Field of the Invention

The present invention relates to a method of fabricating a component having an internal tooth profile such as a multiple disc clutch drum or an internal gear and to a rolling machine thereof 2. Description of the Related Art For example, a large number of methods using a press machine and a die have been reported as means of fabricating a component having internal teeth such as an internal gear or a multiple disc clutch drum including several friction discs. However, since the amount of elastic deformation increases as the size of a press or a die increases, high machining accuracy cannot be expected.

On the other hand, in the field called rolling, there are two main conventional techniques as a method of fabricating a component having an internal tooth profile such as a multiple disc clutch drum or an internal gear.

According to one of the methods, a material to be processed, which has circular inner and outer circumferences, is inserted and fitted into a bar-like inner die having concavity and convexity obtained by transferring and die-sinking an internal tooth profile to be finally obtained so that their inner diameters are aligned. At least one point on the outer circumference of the material is pressed to be deformed in a centripetal direction by a roller, a spatula or the like. The point of application is sequentially moved in a circumferential or axial direction so as to transfer the inner die profile to obtain a component having internal teeth. Leaving aside the question of superiority, this method is characteristic in that the number of teeth of the bar-like inner die and that of the obtained internal teeth are identical with each other.

In the other method, a rolling tool having a tooth die (necessarily with a less number of teeth than that of internal teeth to be obtained), which meshes with an internal tooth profile to be finally obtained in an inscribed manner, is acted on the inner side of a cylindrical material. In the conventional method, a tooth profile substantially already completed in the sense of forming is present inside the cylindrical material to be supplied. At a rolling step, the rolling tool profile is used merely for finishing tooth profile, crowning, and surface roughness finishing. Specifically, the most important requirements for establishment of this conventional method are that a macro load is low because a tool tip does not come into contact with the material to be processed so that deformation is slight, and the stiffness of the material to be processed prevents roundness from being changed (degraded). As a result, a gripping mechanism having a relatively low stiffness can be used. The presence of the gripping mechanism brings about the unexpected effect of serving for initial rotational phasing between an existing tooth profile and a tooth space of a rolling tool.

[Non-Patent Article 1] Catalogue of a Finishing Gear Rolling Machine for Taper Flank of Internal Involute Spline "GR-151N" fabricated by Yutaka Seimitsu Kogyo Ltd.

SUMMARY OF THE INVENTION

The problem in the conventional methods to be solved is how to improve a broaching step and a step using a gear shaper for obtaining a cylindrical material having a substantially completed tooth profile at low cost.

Therefore, the present invention has an object of providing a method of fabricating a component having internal teeth and a rolling machine, which enables large deformation at a main rolling step to omit a broaching step and a step using a gear shaper.

In the method of fabricating a component having internal teeth according to the present invention, instead of using a gripping mechanism for a cylindrical material, a container having a stiffness resistive to an internal pressure as high as that of cold forging is provided. A cylindrical material is inserted into the rotatably driven container in an approximately aligned manner. A rotatably driving rolling tool is acted on the inner side of the cylindrical material to press the cylindrical material so as to sequentially change a distance between a tool rotational shaft and a container rotational axis to successively grow a tooth profile. As a result of an enlarged outer diameter by spreading, the component having internal teeth, which fills the container, is obtained. It is desirable to provide in advance the same number of concave grooves as that of internal teeth to be formed on an inner circumferential face of the cylindrical material at equal intervals.

The rolling machine according to the present invention includes: a rotatably driven container into which a cylindrical material for forming a component having internal teeth is inserted in an aligned manner; a base on which the container is placed through a radial bearing; a rolling tool having external teeth pressed against an inner side of the cylindrical material so as to fabricate internal teeth by rolling; a rolling tool rotational shaft rotatably driving the rolling tool; and a transfer mechanism forcibly moving the rolling tool rotational shaft to forcibly change a distance between a container rotational axis and the rolling tool rotational shaft.

The rolling machine according to the present invention includes: a rotatably driven container into which a cylindrical material for forming a component having internal teeth is inserted in an aligned manner; a base on which the container is placed through a radial bearing; a rolling tool including external teeth pressed against an inner side of the cylindrical material to fabricate internal teeth by rolling; a rolling tool rotational shaft rotatably driving the rolling tool; a transfer mechanism forcibly moving the rolling tool rotational shaft to forcibly change a distance between the container rotational axis and the rolling tool rotational shaft; and a vertical expansion shaft performing either one of changing and toughly keeping an axial position of the container with respect to a position of the tool. The vertical expansion shaft includes either one of at least two numerical control shafts and three independent numerical control shafts provided in parallel at three points surrounding the container rotational axis. The vertical expansion shaft inserts and fits an outer circumference of the container filled with the cylindrical material into an inner side of the radial bearing placed at the base each time rolling processing starts, and can disengage the container and the radial bearing from each other after termination of the rolling processing to discharge a processed product and to insert another cylindrical material. The transfer mechanism includes a purchase wedge pressing a slider connected to the rolling tool rotational shaft and a spring pushing back the slider. The transfer mechanism controls a position of the slider by feeding back data of a distance sensor directly monitoring the position of the slider.

According to the present invention, the component having the internal teeth is adhered to the inner side of the container having a sufficient stiffness ensuring the roundness. The component having the internal teeth does not have any after effect of an unbalanced load due to sequential processing in the middle of processing. Therefore, the component having the internal teeth can provide drastically large deformation by rolling. Moreover, the requirements for the cylindrical material are remarkably relaxed so that a pressed product can be directly provided.

Moreover, according to the present invention, when rolling a helical internal gear with a bottom, improvement is made to obtain class 2 accuracy over the result, which is obtained as a single shaft by setting the three shafts to have the same output-side numerical value. In particular, the effect of improvement of accuracy in correction of a lead error is remarkable.

Furthermore, according to the present invention, a synchronization mechanism between a tool rotation angle of the rolling machine and a container rotation angle, which was conventionally needed, is no longer required. Thus, a rolling machine can be provided at low cost while achieving cold forming of a helical internal gear with a bottom, which was never successful in the conventional technique.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

DESCRIPTION OF THE PREFERRED EMBODIMENTS

First Embodiment

Figure 1:
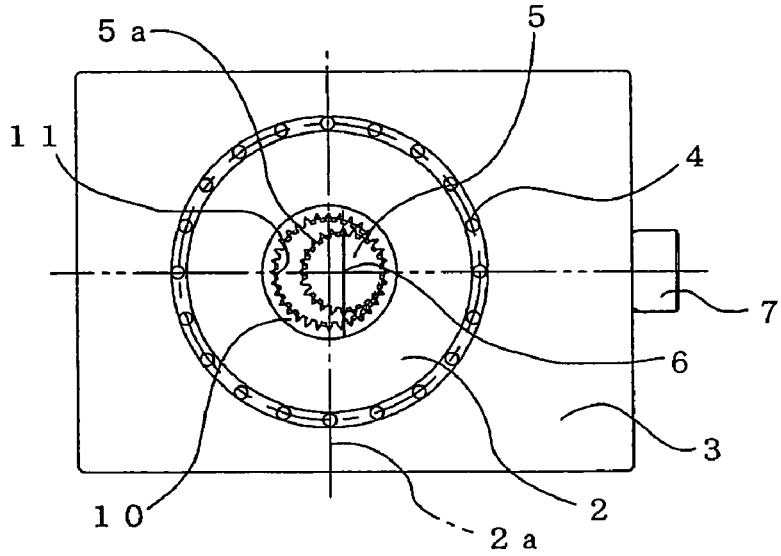
FIG. 1 is a top view showing a rolling machine used for a method of fabricating a helical internal gear with a bottom flange (a component having internal teeth) according to a first embodiment of the present invention.
Figure 2:
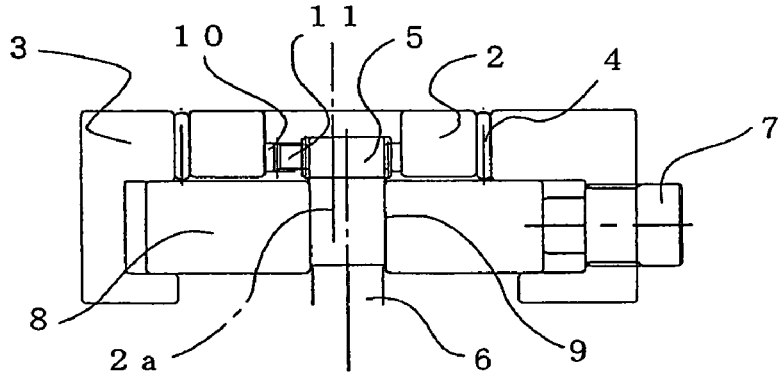
FIG. 2 is a sectional view of FIG. 1.

FIGS. 1 and 2 show a rolling machine 1 used in a method of fabricating a helical internal gear with a bottom flange (a component having internal teeth) 12 according to a first embodiment of the present invention.

The rolling machine 1 includes: a rotatably driven container 2 into which a cylindrical material 10 for forming a component having internal teeth 11 is inserted in an aligned manner; a base 3 on which the container 2 is placed through radial bearings 4; a rolling tool 5 having external teeth 5*a* to be pressed against the inner side of the cylindrical material 10 to fabricate the internal teeth 11 by rolling; a rolling tool rotational shaft 6 for rotatably driving the rolling tool 5; and a transfer mechanism 7 for forcing the rolling tool rotational shaft 6 to relatively move to forcibly change a center distance between a rotational axis 2*a* of the container 2 and the rolling tool rotational shaft 6.

The radial bearings 4 are provided between an outer circumference of the container 2 and an inner circumference of the base 3 also serving as a radial bearing housing.

The rolling tool rotational shaft 6 is fitted into a rolling tool bearing 9 provided to a slider 8. The rolling tool rotational shaft 6 is in communication with a rotary driving device not shown.

The transfer mechanism 7 is composed of a feed cylinder incorporated into the base 3. The transfer mechanism 7 forces the slider 8 to relatively move so as to move the rotational axis 2*a* of the container 2 while the rolling tool rotational shaft 6 is driven.

Next, a method of fabricating the helical internal gear with a bottom flange (the component having the internal teeth) 12 using the thus configured rolling machine 1 according to this embodiment will be described.

Firsts the cylindrical material 10 for forming the component having the internal teeth 11 is inserted into the container 2 rotatably placed on the base 3 in an aligned manner.

Next, the rolling tool 5 is driven. While the rotating external teeth 5*a* are being pressed against the inner face of the cylindrical material 10, the transfer mechanism 7 forces the slider 8 to relatively move to sequentially change the distance between the rotatably driving rolling tool rotational shaft 6 and the rotational axis 2*a* of the container 2. Meanwhile, the cylindrical material 10 is pressed between the external teeth 5*a* of the rolling tool 5 and an inner circumference 2*b* of the container 2 so as to be deformed, thereby sequentially growing the tooth profile. The rolling is completed filling the inner side of the container 2 when the outer diameter of the cylindrical material 10 is enlarged as a result of spreading.

Figure 3:
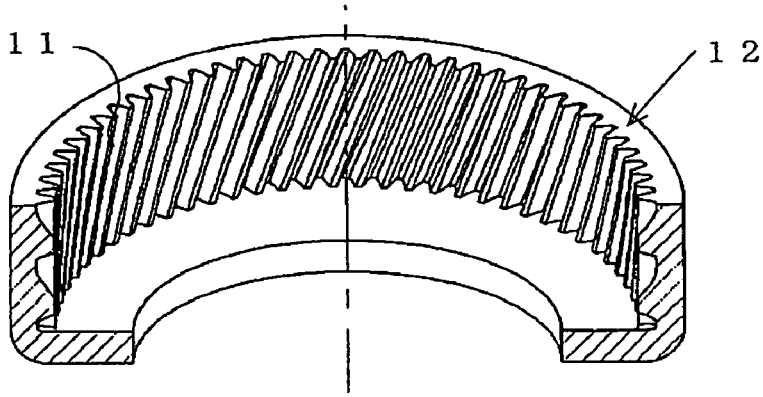
FIG. 3 is an outside view of a helical internal gear with a bottom flange, fabricated according to the first embodiment of the present invention.

In the above-described manner, as shown in FIG. 3, the helical internal gear with a bottom flange 12 corresponding to the component having the internal teeth 11 can be obtained.

Figure 4:
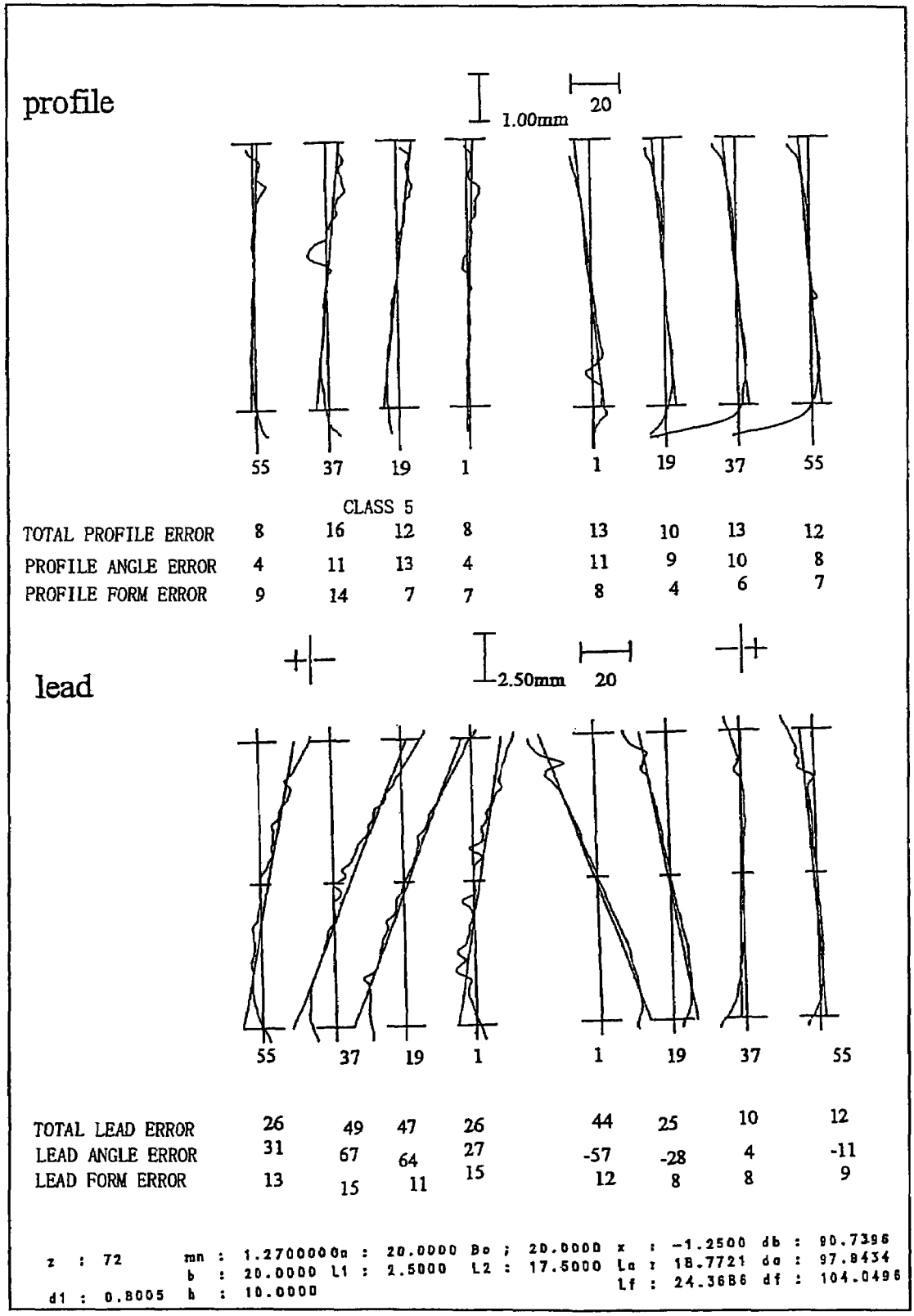
FIG. 4 is a chart showing tooth die accuracy of the helical internal gear with a bottom flange, fabricated according to the first embodiment of the present invention.
Figure 5:
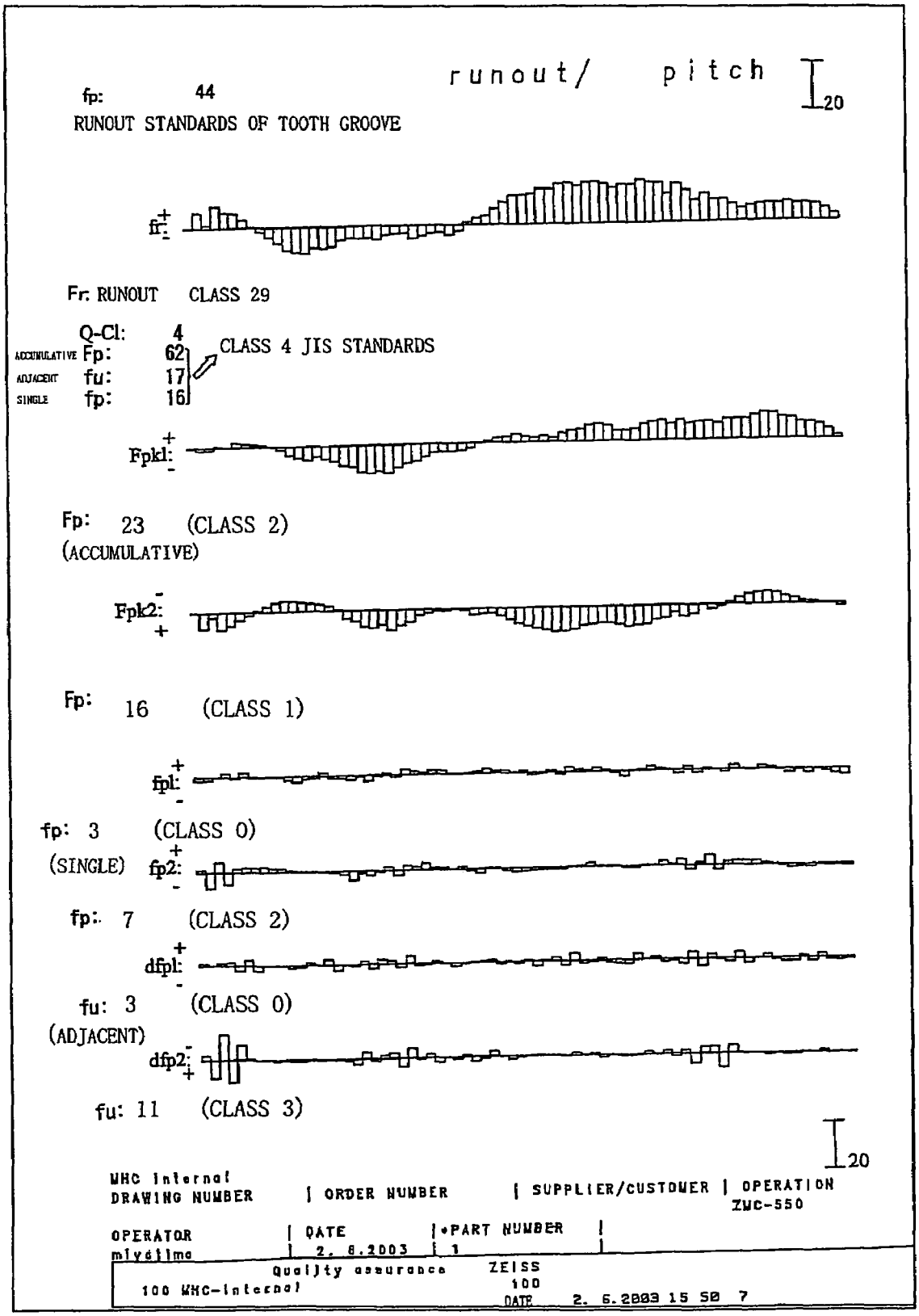
FIG. 5 is a chart showing tooth die accuracy of the helical internal gear with a bottom flange, fabricated according to the first embodiment of the present invention.

FIGS. 4 and 5 are charts showing tooth profile accuracy of the helical internal gear with a bottom flange 12 obtained by this embodiment. The charts are representations achieved by a software of Carl Zeiss Inc. Although the analysis is herein omitted, it is believed that the accuracy is evaluated substantially as that of a JIS class 3 precision gear. However, non-placement of the helical internal gear on the center of rotation and the inclination of the axis are not corrected.

Second Embodiment

Figure 6:
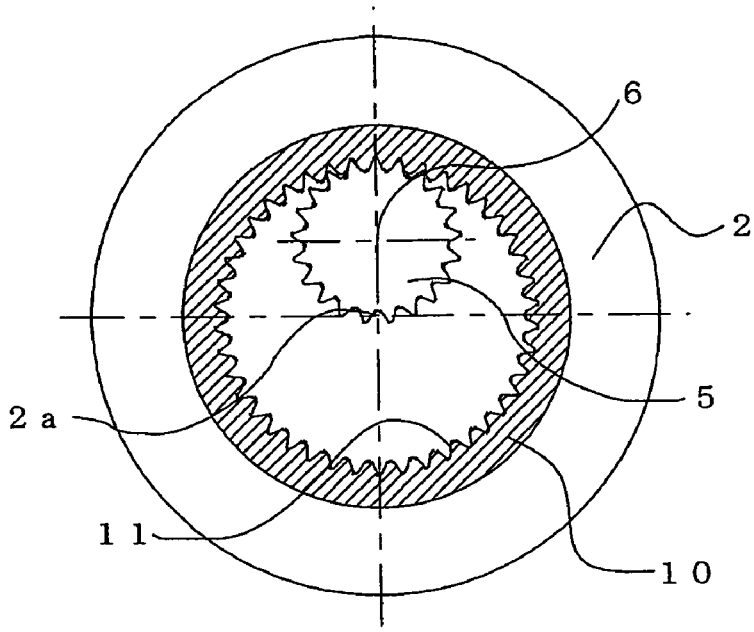
FIG. 6 is a sectional view showing a sectional shape of a component to be formed by rolling, which is perpendicular to the axis, and the arrangement of a rolling tool and a container according to the first embodiment of the present invention.

In the first embodiment, the accuracy of division at equal intervals over the circumference cannot be ensured unless tooth spaces formed immediately after the start of rolling are precisely identical with the external teeth (convex portions) 5*a* of the rolling tool 5 for forming again the tooth spaces deeper after the roll of the material at 360 degrees as shown in FIG. 6. If close adherence between the container 2 and the cylindrical material 10 can be ensured at the initial stage, it is not impossible to synchronize a rotation angle of the rolling tool 5 and that of the cylindrical material 10 through the container 2 in view of a mechanical structure. However, it is not easy to ensure the close adherence between the container 2 and the cylindrical material 10 at the initial stage.

Figure 7:
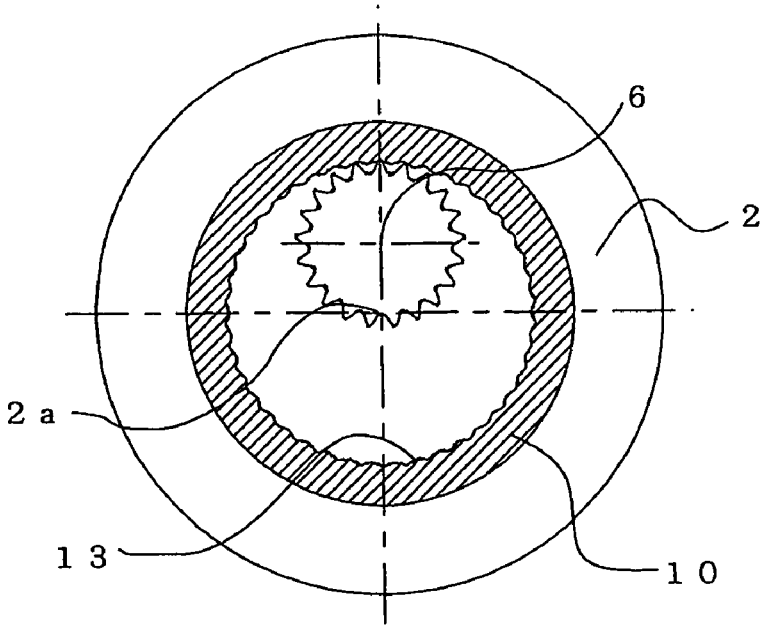
FIG. 7 is a sectional view showing a sectional shape of a cylindrical material, which is perpendicular to the axis, provided for rolling in a devised method and the arrangement of a rolling tool and a container prior to the start of rolling according to a second embodiment of the present invention.
Figure 8:
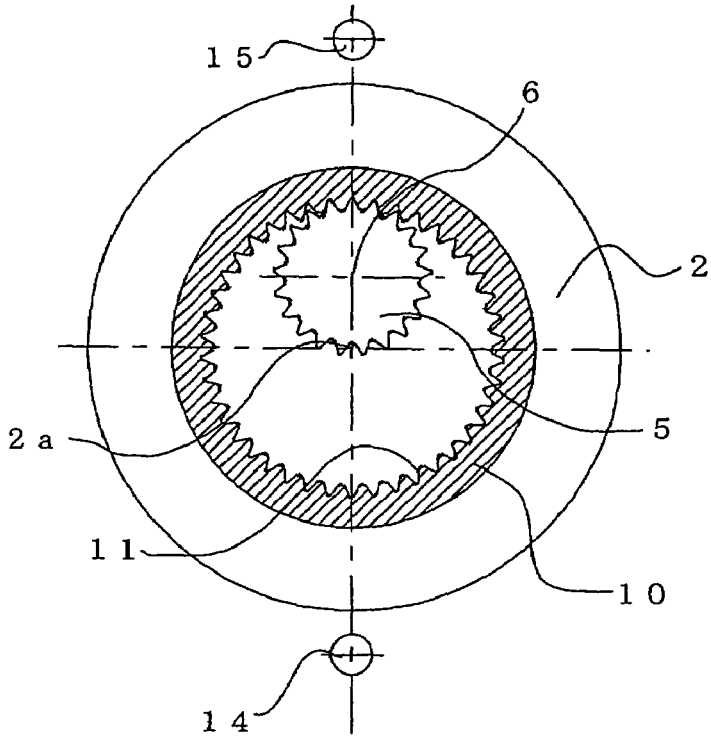
FIG. 8 is a sectional view showing the arrangement of a rolling tool shaft and two expansion shafts with respect to a container rotational axis in a third embodiment of the present invention.

Therefore, in this embodiment, as shown in FIG. 7, instead of realizing the synchronized rotation of the rotation angle of the rolling tool 5 and that of the cylindrical material 10 by controlling the rolling machine, the same number of concave grooves 13 as that of the internal teeth 11 to be formed are provided at equal intervals on the inner circumferential face of the cylindrical material 10, which corresponds to a point of reception of the sequential action. In this manner, the driven-side cylindrical material 10 or the container 2 integral with the cylindrical material 10 synchronously rotates in a spontaneous manner. This spontaneous synchronous rotation is used in this embodiment. Specifically, in this embodiment, attention is focused on the fact that the problem is solved if the cylindrical material 10 synchronously rotates with the rolling tool 5 without losing synchronism, regardless of the integration of the cylindrical material 10 and the container 2. As a result, this embodiment can achieve two objectives at a time: the rotation angle of the rolling tool 5 and that of the container 2 are to be synchronized in the structure of the rolling machine 1; and the presence of a clearance or a slide between the cylindrical material 10 and the container 2 is not allowed.

For carrying out this embodiment, a depth of the concave grooves 13 to be provided in advance at equal intervals on the inner circumferential face of the cylindrical material 10 is satisfactorily 40% or less of that of the internal teeth 11 to be formed. A shape similar to a tooth tip of the rolling tool 5 is suitable as the shape of the concave groove 13. A large press machine is not required for processing the concave grooves 13. Although it is apparent that cutting using a broach or a slotter can be used as means of processing the concave grooves 13 without any problem, it is totally different from a 99% tooth profile like a material used for conventional finish rolling.

Moreover, according to this embodiment, the same number of gentle concave grooves 13 having a small level difference as that of teeth to be obtained are provided in advance on the inner side of the cylindrical material 10. Since the cylindrical material 10 is perfectly rotatable at the initial stage of rolling, the problem peculiar to rolling that two teeth are initially formed for one groove can be solved.

Since the components in this embodiment other than the cylindrical material 10 are the same as those in the first embodiment, the description thereof is herein omitted.

Third Embodiment

In the rolling machine 1 used in the first embodiment, that is, the machine of inserting the cylindrical material 10 for forming a component into the rotatably driven container 2 in an approximately aligned manner so as to press and deform the cylindrical material 10 between the rotatably driving rolling tool 5 and the inner side of the container 2 to process the component 12 having the internal teeth 11 by rolling, a cantilever mechanism is obliged to be used for holding the rolling tool shaft 6 in view of the convenience of insertion and removal of a processed product and the like. Therefore, a pressing pressure corresponding to a processing stress necessarily requires the elastic bent of the rolling tool shaft 6. Accordingly, in this embodiment, the rotational axis 2*a* of the container 2 is forced to be inclined toward the rolling tool shaft 6, which is no longer parallel, by similarly using elastic deflection. As a mechanism of restoring a parallel state, two expansion shafts 14 and 15 are provided on a line connecting the rolling tool shaft 6 and the rotational axis 2*a* of the container 2 on the outer side of the rolling tool shaft 6 and the rotational axis 2*a*. The two expansion shafts 14 and 15 are individually expanded and contacted to force the container 2 to be inclined. In this manner, this embodiment achieves the mechanism of restoring a parallel state.

After confirming a state where the container 2 is horizontally held under no load as a difference zero point, an output-side theoretical final point of each of the two expansion shafts (control shafts) 14 and 15 at the rolling termination stage is actively offset by, for example, about 0.3 mm.

Even if the effects are reduced by the deflection of the axis of a ball screw or the like, inclination of the container 2 for about 0.1 mm can be generated with respect to an axial span of 250 mm. The inclination corresponds to improvement or correction of about 10 μm for 25 mm of inclination of an over pin diameter of the gear or a helix angle error.

Fourth Embodiment

In this embodiment, even a gear lead or a helix angle of a product obtained by rolling, which is determined by a gear lead or a helix angle originally provided on the rolling tool 5 in the third embodiment, is controlled within an extremely small range.

Figure 9:
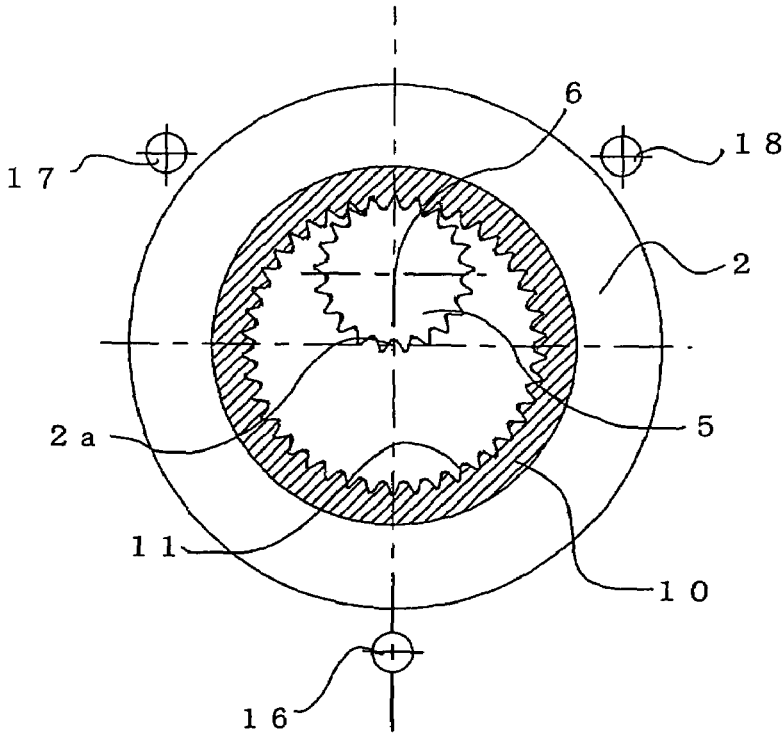
FIG. 9 is a sectional view showing the arrangement of a rolling tool shaft and three expansion shafts with respect to a container rotational axis in a fourth embodiment of the present invention.

In this embodiment, as shown in FIG. 9, three expansion shafts (control shafts) 16, 17, and 18 are provided for the fixed rolling tool shaft 6 at three positions so as to surround the rotational axis 2*a* to force the rotational axis 2 of the container 2 to be deflected in an elastic deflection area. Each of the expansion shafts 16, 17, and 18 can be numerically controlled in an independent manner.

After the confirmation of a state where the container 2 is horizontally held under no load as a difference zero point, an output-side theoretical final point of each of the three expansion shafts (control shafts) 16, 17, and 18 at the rolling termination stage is actively offset by, for example, about 0.3 mm.

Even if the effects are reduced by the deflection of the axis of a ball screw or the like, inclination of the container 2 of about 0.1 mm can be generated with respect to an axial span of 250 mm. The inclination corresponds to improvement or correction of about 10 μm for 25 mm of inclination of an over pin diameter of the gear or a helix angle error.

By employing the independent control of the three shafts, the elastic bent of the rolling tool shaft 6 can be offset, the internal gear can be crowned, a lead can be regulated even within an extremely small range, and the like.

This embodiment intends to actively correct extremely small inconveniences regarding gear accuracy, for example, the rolling tool 5 side of the container 2 corresponding to the open side opens due to the elastic deformation of the container 2 to result in a rolled product with a conical pitch cylinder, or a lead is changed by a change in the amount of displacement even if a helical angle of the rolling tool 5 is as set.

In this embodiment, the rotational axis 2*a* of the container 2 corresponding to the rolling tool shaft 6 is deflected in an X-axis direction as well as in a Y-axis direction. Therefore, it is required to provide at least three shafts. Unless the expansion and contraction of the three shafts are individually controlled, this embodiment cannot be achieved.

For carrying out this embodiment, the following specific arrangement of the three shafts is believed to be directly linked to efficiency and ease of control. Specifically, one expansion shaft 16 is provided on the line connecting the rolling tool shaft 6 that would be deflected by a pressing force and the rotational axis 2*a* of the container 2, whereas the other two expansion shafts 17 and 18 are provided evenly on both the sides of the line.

Fifth Embodiment

FIGS. 10 to 13 shows a rolling machine according to this embodiment.

FIGS. 10 to 13 shows a rolling machine 20 used in a method of fabricating the helical internal gear with a bottom flange (the component having the internal teeth) 12 according to the fifth embodiment of the present invention.

The rolling machine 20 includes: a rotatably driven container 21 into which the cylindrical material 10 for forming the component having the internal teeth 11 is inserted in an aligned manner; a fixed base 28 including a radial bearing 29 with which the container 21 is engaged; a roiling tool 36 having external teeth 36*a* to be pressed against the inner side of the cylindrical material 10 to fabricate the internal teeth 11 by rolling; a rolling tool rotational shaft 37 for rotatably driving the rolling tool 36; and a transfer mechanism 40 for forcing the rolling tool rotational shaft 37 to forcibly change a distance between a rotational axis 21*a* of the container 21 and the rolling tool rotational shaft 37.

The container 21 is rotatably provided through a thrust bearing 24 on a table 23 fixed on a lifting NC shaft 22. The lifting NC shaft 22 is provided on a shelf 26 located below the fixed base so as to be lifted up and down. A lift guide rod 25 pivotally supported on the shelf 26 so as to be lifted up and down is provided for the table 23. The lifting NC shaft 22 is operated by a Z-axis NC motor 27 so as to be lifted up and down.

The fixed base 28 includes: a hole 30 for attachment of the radial bearing 29; a hole 31 for lifting up and down a purchase wedge 41 of the transfer mechanism 40; a slider placement surface 32 for slidably placing a slider 39 for supporting and fixing a rolling tool device 38 including the rolling tool 36; four slider guides 33 provided on both sides of the slider placement surface 32; pushback springs 34 of the slider 39, provided so as to be opposed to the hole 31; and a side distance sensor 35 for monitoring an end of the slider 39.

The rolling tool 36 is attached to the rolling tool device 38 including a motor with a reduction gear through the rolling tool shaft 37. The rolling tool device 38 is fixed to the slider 39. The transfer mechanism 40 includes: the purchase wedge 41 being lifted up and down through the hole 31 in the fixed base 28; a pressing NC shaft 42 for lifting up and down the purchase wedge 41; the pushback springs 34 provided for the fixed base 28; and the side distance sensor 35 provided for the fixed base 28. The pressing NC shaft 42 is pivotably supported by the shelf 26 and is operated by the NC motor 43 so as to be lifted up and down. The side distance sensor 35 directly monitors the position of the slider 39 so as to feeds back the data to a control device not shown. The control device is provided in a control box 44.

The control device performs, for example, control as follows.

Control of a pressing force (a current value of the NC motor, that is, a torque) for press processing;

Control of a center distance between the shafts with respect to a rotation angle of the tool shaft;

Determination of a combination of light-hand rotation and left-hand rotation of the tool shaft; and Determination of a rotational acceleration at the start after suspension for changing a rotation angle.

Although it is apparent that the control in the control device is executed in accordance with programs at the start of rolling, during the rolling, and at the end of rolling, the details thereof are herein omitted.

It is apparent that not only the forced acceleration of pressing in accordance with the rotation angle of the rolling tool 36 but also various conditions for accelerating the rolling such as reverse time (or the number of revolutions) of the rolling tool rotational shaft 37, a rotational acceleration at the start of reverse and the final position of each of the expansion shafts are set by processing all the information required for automatic operation with high reproducibility such as monitoring an abnormal value of a pressing force through the NC motor current value or obtaining the data from the side distance sensor as a trigger of a rolling termination routine (free rotation for all around uniform rolling and the like).

Next, a method of fabricating the helical internal gear with a bottom flange (the component having the internal teeth) 12 using the rolling machine 20 configured as described above according to this embodiment will be described.

Figure 11:
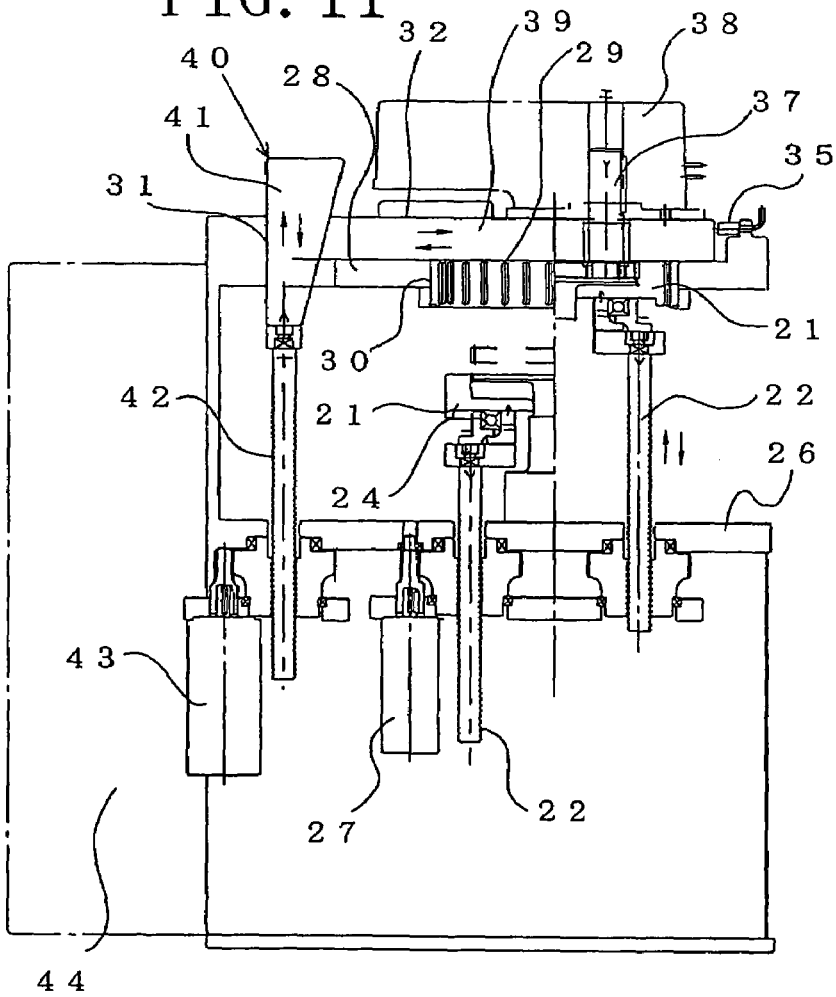
FIG. 11 is a front view of the rolling machine in the fifth embodiment of the present invention.
Figure 12:
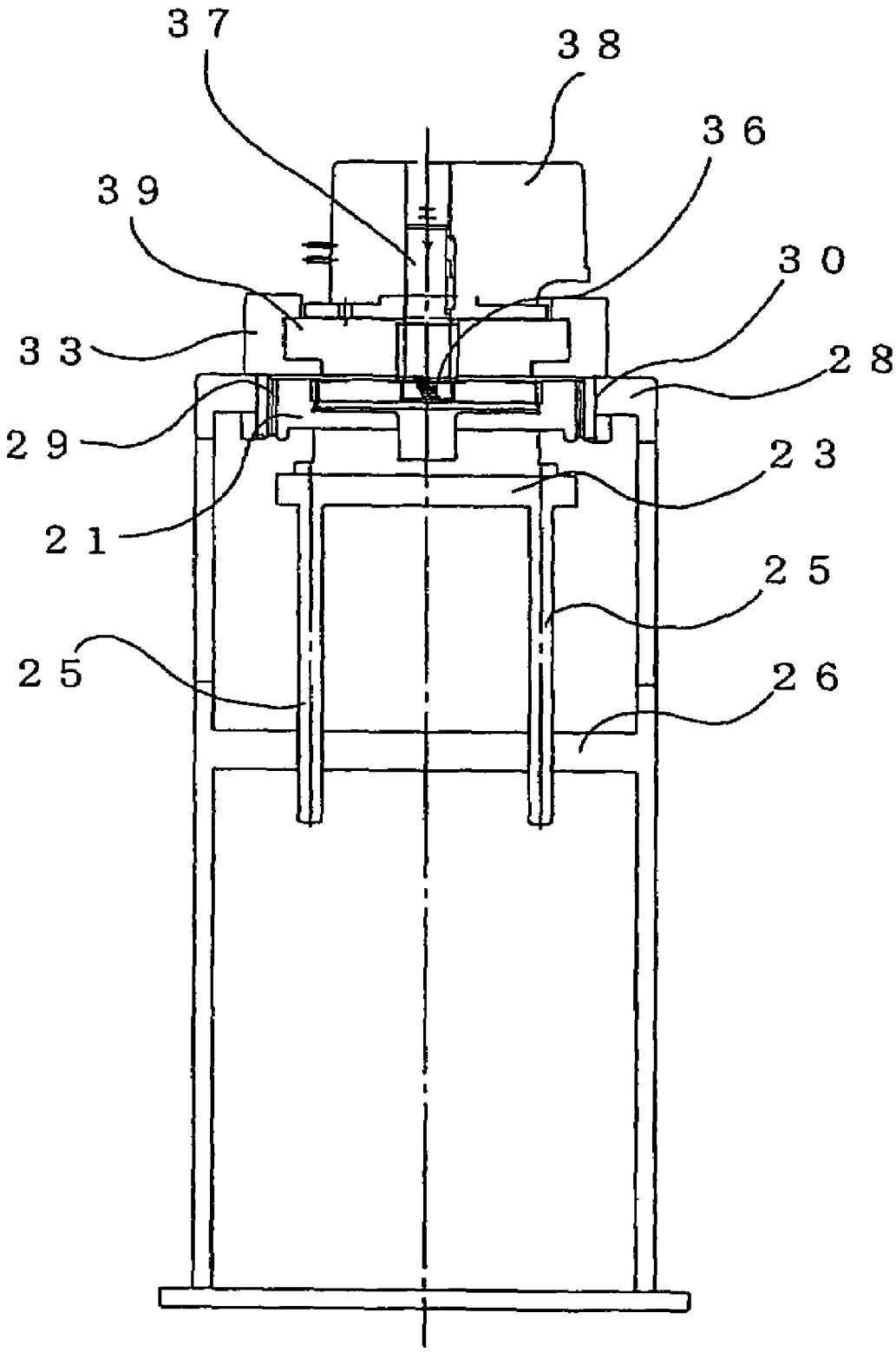
FIG. 12 is a side view of the rolling machine in the fifth embodiment of the present invention.
Figure 13:
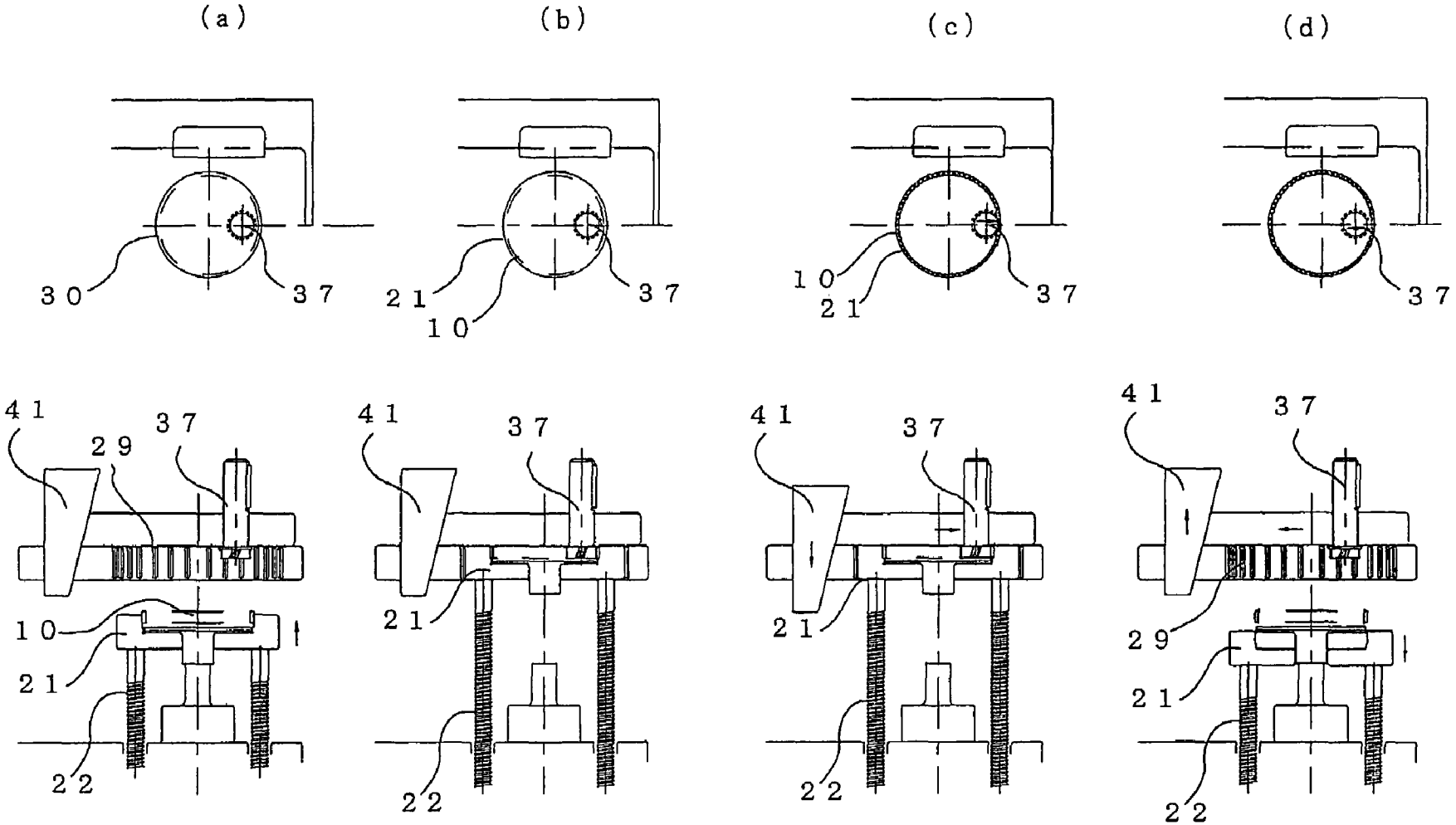
FIG. 13 is an explanatory view showing a method of fabricating a helical internal gear with a bottom flange (a component having internal teeth) using the rolling machine in the fifth embodiment of the present invention.

First, as shown in FIGS. 11 and 13(*a*), the cylindrical material 10 for forming the component having the internal teeth 11 is inserted into the container 21, which is being lifted down from the fixed base 28, in an aligned manlier.

Next, as shown in FIGS. 11 and 13(*b*), the Z-axis NC motor 27 is driven so as to lift the lifting NC shaft 22 up to fit the container 21 into the radial bearing 29 of the fixed base 28. In this manner, the container 21 is engaged with the radial bearing 29.

Figure 10:
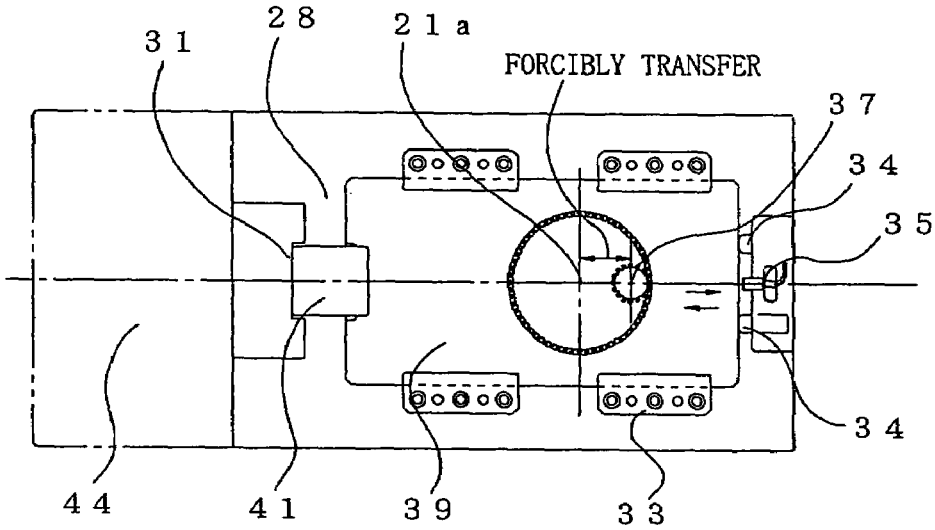
FIG. 10 is a top view of a rolling machine in a fifth embodiment of the present invention.

Next, as shown in FIGS. 10 and 13(*c*), the rolling tool device 38 aid the transfer mechanism 40 are driven. As a result, the slider 39 forces the rolling tool shaft 37 to be changed as indicated with an arrow in FIG. 9 with the elevation of the purchase wedge 41 of the transfer mechanism 40 while the rotating external teeth 36*a* of the rolling tool 36 are being pressed against the inner face of the cylindrical material 10. Specifically, first, the purchase wedge 41 of the transfer mechanism 40 pushes the slider 39 toward the pushback springs 34 while being pulled into the hole 31 by the pressing NC shaft 42 pulled with the rotation caused by the NC motor 43. As a result, the rolling tool shaft 37 is forced toward the pushback spring 34. Next, the purchase wedge 41 of the transfer mechanism 40 is pulled up from the hole 31 by the pressing NC shaft 42 that is also pulled up with the rotation caused by the NC motor 43. Along with the pull, the slider 39 is pushed back toward the purchase wedge 41 by a repellent force of the pushback springs 34. Thereafter, the forced changes in the two directions are applied to the rolling tool shaft 37 so as to achieve the rolling by pressing.

Next, as shown in FIGS. 11 and 13(*d*), the Z-axis NC motor 27 is driven so as to lift the lifting NC shaft 22 down. After the container 21 and the radial bearing 29 are disengaged from each other to restore the container 21 to its original position, a processed product is discharged.

By the above process, the helical internal gear with a bottom flange 12, which corresponds to the component having the internal teeth 11, can be obtained as shown in FIG. 3.

According to this embodiment, the following advantages can be obtained.

The Output of the NC shafts 22 and 42 can be reduced to a fraction of a pressing force.

An angular change of the purchase wedge 41 allows the limit of the pressing force to be adjusted by replacement of two components.

A change in necessary pressing force for rolling or a fluctuation in rolling reaction force is absorbed by a frictional force through the purchase wedge 41 (while compensating for a low stiffness of the NC shafts 22 and 42) so as to keep the center distance between the rolling tool shaft 37 and the rotational axis 21*a* of the container 21 with a high stiffness.

Backlash in the center distance direction between the rolling tool shaft 37 and the rotational axis 21*a* of the container 21 is eliminated regardless of backlash present on the NC shafts 22 and 42 side.

The center distance is directly monitored regardless of the rotation angle of the NC motor 27 or 43 to enable the highly accurate control of the center distance.

The data from the distance sensor 35 enables the confirmation of the accuracy of a product in conformity with a gear rolling test.

In this embodiment, it is desirable to provide the two control shafts 14 and 15 described in the third embodiment or the three expansion shafts (control shafts) 16, 17, and 18 described in the fourth embodiment. The arrangement and the operation control of the two control shafts 14 and 15 or the three expansion shafts (control shafts 16, 17, and 18) are the same as those in the third or fourth embodiment.

The invention is not limited to the above embodiments and various modifications may be made without departing from the spirit and scope of the invention. Any improvement may be made in part or all of the components.

What is claimed is:

1. A method of fabricating a component having internal teeth, comprising the steps of:

inserting a cylindrical material for forming a component having internal teeth into a rotatably driven container in an approximately aligned manner;

placing said container through a radial bearing on a base;

rotatable driving a rolling tool having external teeth to be pressed against an inner side of said cylindrical material to fabricate an inner teeth by rolling and a rolling tool rotational shaft rotatable driving said rolling tool;

pressing and deforming the cylindrical material between an outer circumference of said rolling tool and an inner circumference of said container to successively grow a tooth profile while forcibly changing a center distance between said rolling tool rotational shaft and a rotational axis of said container by relatively moving said rolling tool rotational shaft forcibly as the external teeth of said rotatable driving rolling tool rotational shaft are being pressed against an inner face of said cylindrical material;

completing rolling in a state where the cylindrical material fills said container as a result of an enlarged outer diameter by spreading; and discharging a processed component having internal teeth from said container.

2. The method of fabricating the component having internal teeth according to claim 1, further comprising a step of:

providing in advance a same number of concave grooves as that of internal teeth to be formed on an inner circumferential surface of said cylindrical material at equal intervals.

3. A rolling machine for fabricating a component having internal teeth comprising:

a rotatably driven container into which a cylindrical material for forming a component having internal teeth is inserted in an aligned manner;

a base on which said container is placed through a radial bearing;

a rolling tool having external teeth pressed against an inner side of said cylindrical material to fabricate the internal teeth by rolling;

a rolling tool rotational shaft rotatably driving said rolling tool;

a slider fitting said rolling tool rotational shaft into a rolling tool bearing; and a transfer mechanism forcibly moving said rolling tool rotational shaft to forcibly change a distance between a rotational axis of said container and said rolling tool rotational shaft and moving the rotation axis of said container by relatively moving said slider forcibly while said rolling tool rotational shaft is driven.

4. A rolling machine for fabricating a component having internal teeth comprising:

a rotatably driven container into which a cylindrical material for forming the component having internal teeth is inserted in an aligned manner;

a base on which said container is placed through a radial bearing;

a rolling tool having external teeth pressed against an inner side of said cylindrical material to fabricate the internal teeth by rolling;

a rolling tool rotational shaft rotatably driving said rolling tool;

a slider fitting said rolling tool rotational shaft into a rolling tool bearing;

a transfer mechanism forcibly moving said rolling tool rotational shaft to forcibly change a distance between a rotational axis of said container and said rolling tool rotational shaft and moving the rotation axis of said container by relatively moving said slider forcibly while said rolling tool rotational shaft is driven; and a vertical expansion shaft performing either one of changing and toughly keeping an axial position of said container with respect to a position of the tool.

5. The rolling machine for fabricating the component having internal according to claim 4, wherein said vertical expansion shaft includes at least two numerical control shafts.

6. The rolling machine for fabricating the component having internal teeth according to claim 4, wherein said vertical expansion shaft includes three independent numerical control shafts arranged in parallel at three points surrounding the container rotational axis.

7. The rolling machine for fabricating the component having internal teeth according to claim 4, wherein said vertical expansion shaft inserts and fits an outer circumference of the container filled with said cylindrical material into an inner side of the radial bearing placed at the base each time rolling processing starts, and disengages the container and the radial bearing from each other after termination of the rolling processing to discharge a processed product and to insert another cylindrical material.

8. The rolling machine for fabricating the component having internal teeth according to claim 4, wherein said transfer mechanism includes a purchase wedge pressing a slider connected to the rolling tool rotational shaft and a spring pushing back the slider, the transfer mechanism controlling a position of said slider by feeding back data of a distance sensor directly monitoring the position of said slider.

9. A rolling machine comprising:

a rotatably driven container into which a cylindrical material for forming a component having internal teeth is inserted in an aligned manner;

a base on which said container is placed through a radial bearing;

a rolling tool having external teeth pressed against an inner side of said cylindrical material to fabricate the internal teeth by rolling;

a rolling tool rotational shaft rotatably driving said rolling tool;

a transfer mechanism forcibly moving said rolling tool rotational shaft to forcibly change a distance between a rotational axis of said container and said rolling tool rotational shaft; and a vertical expansion shaft performing either one of changing and toughly keeping an axial position of said container with respect to a position of the tool, wherein said vertical expansion shaft includes at least two numerical control shafts.

10. A rolling machine comprising:

a rotatably driven container into which a cylindrical material for forming a component having internal teeth is inserted in an aligned manner;

a base on which said container is placed through a radial bearing;

a rolling tool having external teeth pressed against an inner side of said cylindrical material to fabricate the internal teeth by rolling;

a rolling tool rotational shaft rotatably driving said rolling tool;

a transfer mechanism forcibly moving said rolling tool rotational shaft to forcibly change a distance between a rotational axis of said container and said rolling tool rotational shaft; and a vertical expansion shaft performing either one of changing and toughly keeping an axial position of said container with respect to a position of the tool, wherein said vertical expansion shaft includes three independent numerical control shafts arranged in parallel at three points surrounding the container rotational axis.

11. A rolling machine comprising;

a rotatably driven container into which a cylindrical material for forming a component having internal teeth is inserted in an aligned manner;

a base on which said container is placed through a radial bearing;

a rolling tool having external teeth pressed against an inner side of said cylindrical material to fabricate the internal teeth by rolling;

a rolling tool rotational shaft rotatably driving said rolling tool;

a transfer mechanism forcibly moving said rolling tool rotational shaft to forcibly change a distance between a rotational axis of said container and said rolling tool rotational shaft; and a vertical expansion shaft performing either one of changing and toughly keeping an axial position of said container with respect to a position of the tool, wherein said transfer mechanism includes a purchase wedge pressing a slider connected to the rolling tool rotational shaft and a spring pushing back the slider, the transfer mechanism controlling a position of said slider by feeding back data of a distance sensor directly monitoring the position of said slider.

* * * * *

UNITED STATES PATENT AND TRADEMARK OFFICE

CERTIFICATE OF CORRECTION

PATENT NO. : 7,331,206 B2
APPLICATION NO. : 10/560535
DATED : February 19, 2008
INVENTOR(S) : Tsuyoshi Aoyama It is certified that error appears in the above-identified patent and that said Letters Patent is hereby corrected as shown below:

Col. 4, line 57, delete “Firsts” and replace with -- First --

Col. 6, line 37, delete “contacted” and replace with -- contracted --

Col. 7, line 50, delete “roiling” and replace with -- rolling --

Col. 8, line 29, delete “light” and replace with -- right --

Col. 8, line 58, delete “manlier” and replace with -- manner --

Col. 8, line 65, delete “aid” and replace with -- and --

Claim 1, Col. 10, line 2, delete “rotatable” and replace with -- rotatably --

Claim 1, Col. 10, line 5, delete “rotatable” and replace with -- rotatably --

Claim 1, Col. 10, line 13, delete “rotatable” and replace with -- rotatably --

Claim 5, Col. 11, line 5, after the word *internal* insert -- teeth --

Signed and Sealed this

First Day of July, 2008

JON W. DUDAS
*Director of the United States Patent and Trademark Office*